US011131170B2

(12) United States Patent
Alsunnary et al.

(10) Patent No.: US 11,131,170 B2
(45) Date of Patent: Sep. 28, 2021

(54) ELECTRICAL SUBMERSIBLE PUMP COMPLETION IN A LATERAL WELL

(71) Applicant: Saudi Arabian Oil Company, Dhahran (SA)

(72) Inventors: Khaled Alsunnary, Dammam (SA); Ahmed Alkhalifah, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/587,512

(22) Filed: Sep. 30, 2019

(65) Prior Publication Data

US 2021/0095550 A1 Apr. 1, 2021

(51) Int. Cl.
*E21B 43/12* (2006.01)
*E21B 41/00* (2006.01)

(52) U.S. Cl.
CPC ..... *E21B 43/128* (2013.01); *E21B 41/0035* (2013.01)

(58) Field of Classification Search
CPC ..... E21B 43/128; E21B 41/0035; E21B 43/13
See application file for complete search history.

(56) References Cited

U.S. PATENT DOCUMENTS 6,119,780 A * 9/2000 Christmas ..... E21B 43/128 166/313
6,923,275 B2 * 8/2005 Gardes ..... E21B 41/0035 175/61
8,316,942 B2 * 11/2012 Brown ..... E21B 43/128 166/313
9,322,250 B2 * 4/2016 Johnson ..... E21B 43/12
9,598,943 B2 * 3/2017 Hughes ..... E21B 43/128
2013/0068453 A1 3/2013 Al-Ajaji et al.
2019/0226303 A1 * 7/2019 Billington ..... E21B 43/013

FOREIGN PATENT DOCUMENTS

WO WO 199840603 9/1998
WO WO 2018005910 1/2018

OTHER PUBLICATIONS

PCT International Search Report and Written Opinion in International Appln. No. PCT/US2020/053389, dated Dec. 18, 2020, 13 pages.

* cited by examiner

*Primary Examiner* — Nicole Coy
(74) *Attorney, Agent, or Firm* — Fish & Richardson P.C.

(57) ABSTRACT

Electrical submersible pump (ESP) completion in a lateral wellbore includes an ESP installed in a wellbore that includes a vertical wellbore portion and a lateral wellbore portion that is connected to the vertical wellbore portion at a junction. The ESP is installed in the vertical wellbore portion downhole of the junction. The lateral wellbore portion extends to a subsurface hydrocarbon reservoir carrying hydrocarbons. Using the ESP, at least a portion of the hydrocarbons is produced through the lateral wellbore portion.

19 Claims, 2 Drawing Sheets

ELECTRICAL SUBMERSIBLE PUMP COMPLETION IN A LATERAL WELL

TECHNICAL FIELD

This disclosure relates to wellbore formation and completion.

BACKGROUND

Hydrocarbons trapped in subsurface hydrocarbon reservoirs are produced (that is, raised to the surface) through wellbores from the surface to the subsurface hydrocarbon reservoirs. During primary recovery operations, the hydrocarbons (for example, oil, natural gas, or combinations of them) are trapped under pressure (called formation pressure) which drives the flow of the hydrocarbons through the wellbore to the surface. Over time, the formation pressure drops. In such instances, secondary recovery operations are implemented to produce the hydrocarbons. Implementing an electrical submersible pump (ESP) is an example of a secondary recovery operation. In such an operation, the ESP is disposed at a downhole location in the wellbore. When operated, the ESP draws the hydrocarbons from the downhole location and drives them towards the surface. The process of installing the ESP at the downhole location is called an ESP completion process and the ESP installed at the downhole location is called an ESP completion. Conventional ESP consists of pump (stages that rotate to push the fluid up), seal (to protect the motor from the wellbore fluid), and motor, respectively.

SUMMARY

This disclosure describes technologies relating to installing an ESP completion in a lateral well.

Certain aspects of the subject matter described here can be implemented as a method. An electrical submersible pump (ESP) is installed in a wellbore that includes a vertical wellbore portion and a lateral wellbore portion that is connected to the vertical wellbore portion at a junction. The ESP is installed in the vertical wellbore portion downhole of the junction. The lateral wellbore portion extends to a subsurface hydrocarbon reservoir carrying hydrocarbons. Using the ESP, at least a portion of the hydrocarbons is produced through the lateral wellbore portion.

An aspect combinable with any other aspect can include the following features. To produce at least the portion of the hydrocarbons through the lateral wellbore portion, the ESP can draw at least the portion of the hydrocarbons from the subsurface hydrocarbon reservoir through the lateral wellbore portion and into the vertical wellbore portion. The ESP can drive at least the portion of the hydrocarbons drawn into the vertical wellbore portion in an uphole direction towards a surface.

An aspect combinable with any other aspect can include the following features. The vertical wellbore can be cased. A portion of the lateral wellbore portion can be cased.

An aspect combinable with any other aspect can include the following features. An entirety of the vertical wellbore portion, including a downhole end of the vertical wellbore portion, can be cased.

An aspect combinable with any other aspect can include the following features. To draw at least the portion of the hydrocarbons from the subsurface hydrocarbon reservoir through the lateral wellbore portion and into the vertical wellbore portion, the ESP generates a low-pressure region within the vertical wellbore portion. The low-pressure region has a lower pressure compared to the lateral wellbore portion. At least the portion of the hydrocarbons is drawn into the low-pressure region within the vertical wellbore portion.

An aspect combinable with any other aspect can include the following features. The ESP includes a motor and pump. The pump inlet is configured to receive at least the portion of the hydrocarbons to be flowed by the ESP. The motor is configured to drive the ESP. The motor is installed uphole of the pump inlet.

An aspect combinable with any other aspect can include the following features. A production tubing is installed uphole of the ESP. The production tubing fluidically couples to the ESP and extends to the surface. To produce at least the portion of the hydrocarbons through the lateral wellbore portion, the ESP flows at least the portion of the hydrocarbons through the production tubing.

An aspect combinable with any other aspect can include the following features. An annulus is defined between an outer surface of the production tubing and an inner wall of the wellbore uphole of the junction. The annulus is sealed.

Certain aspects of the subject matter described can be implemented as a method. A wellbore is formed extending from a surface of the Earth towards a subsurface hydrocarbon reservoir carrying hydrocarbons. At a junction at the downhole location, the wellbore is split into a vertical wellbore portion and a lateral wellbore portion deviating from the vertical wellbore portion. An ESP is installed in the vertical wellbore portion downhole of the junction. Using the ESP, at least a portion of the hydrocarbons is produced through the lateral wellbore portion.

An aspect combinable with any other aspect can include the following features. To produce at least the portion of the hydrocarbons through the lateral wellbore portion, the ESP produces at least a portion of the hydrocarbons from the subsurface hydrocarbon reservoir through the lateral wellbore portion into the vertical wellbore portion and from the vertical wellbore portion in an uphole direction towards the surface.

An aspect combinable with any other aspect can include the following features. The vertical wellbore portion is cased, and a portion of the lateral wellbore portion is cased.

An aspect combinable with any other aspect can include the following features. To case the vertical wellbore portion, the entirety of the vertical wellbore portion, including a downhole end of the vertical wellbore portion, is cased.

An aspect combinable with any other aspect can include one or more of the following features. To produce at least the portion of the hydrocarbons through the lateral wellbore portion, the ESP draws at least the portion of the hydrocarbons into a low-pressure region within the vertical wellbore portion downhole of the junction.

An aspect combinable with any other aspect can include one or more of the following features. The ESP includes a motor and a pump inlet. The pump inlet is configured to receive at least a portion of the hydrocarbons to be flowed by the ESP. The motor is configured to drive the ESP. The motor is installed uphole of the pump inlet.

An aspect combinable with any other aspect can include one or more of the following features. A production tubing is installed uphole of the ESP. The production tubing is fluidically coupled to the ESP and extends to the surface. To produce at least the portion of the hydrocarbons through the lateral wellbore portion, the ESP flows at least a portion of the hydrocarbons through the production tubing.

An aspect combinable with any other aspect can include one or more of the following features. An annulus is defined between an outer surface of the production tubing and an inner wall of the wellbore uphole of the junction. The annulus is sealed.

Certain aspects of the subject matter described can be implemented as a method. A wellbore extending from a surface of the Earth is formed towards a subsurface hydrocarbon reservoir carrying hydrocarbons. At a junction at a downhole location, the wellbore is split into a vertical wellbore portion and a lateral wellbore portion deviating from the vertical wellbore portion. An ESP is installed in the vertical wellbore portion downhole of the junction. Using the ESP, at least a portion of the hydrocarbons is produced through the lateral wellbore portion.

An aspect combinable with any other aspect can include one or more of the following features. A production tubing fluidically coupled to the ESP is installed uphole of the ESP and extends to the surface. At least the portion of the hydrocarbons is produced through the production tubing.

An aspect combinable with any other aspect can include one or more of the following features. The production tubing defines an annulus between an outer wall of the production tubing and an inner wall of the wellbore. The annulus is sealed uphole of the junction.

An aspect combinable with any other aspect can include one or more of the following features. To seal the junction uphole of the ESP, a packer is installed uphole of the junction sealing the annulus.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes well completion in a lateral wellbore. In a lateral wellbore, the ESP is typically installed above the junction/window from which the lateral well extends into the formation. Alternatively, the ESP is installed within the lateral well. In this disclosure, a vertical well is drilled below the junction/window, and the ESP is lowered vertically into the vertical well and installed below the junction/window. During production, production fluid (for example, hydrocarbons from a subsurface hydrocarbon reservoir) from the lateral well flows to the junction and the downhole into the vertical well. From the vertical well, the ESP draws the fluid and pumps it in an uphole direction. By this arrangement, the electrostatic head for the ESP (that is, the volume of fluid from the ESP inlet to the bottom of the well) decreases. Therefore, the ESP operates at a higher efficiency. Also, the well completion, specifically, lowering the ESP into a vertical well, is easier than installing the ESP in the lateral well. Implementing the ESP completion described here can maximize ESP performance and prolong ESP running life. Moreover, lowering the ESP inlet prevents the possibility of separating gas downhole.

Figure 1A:
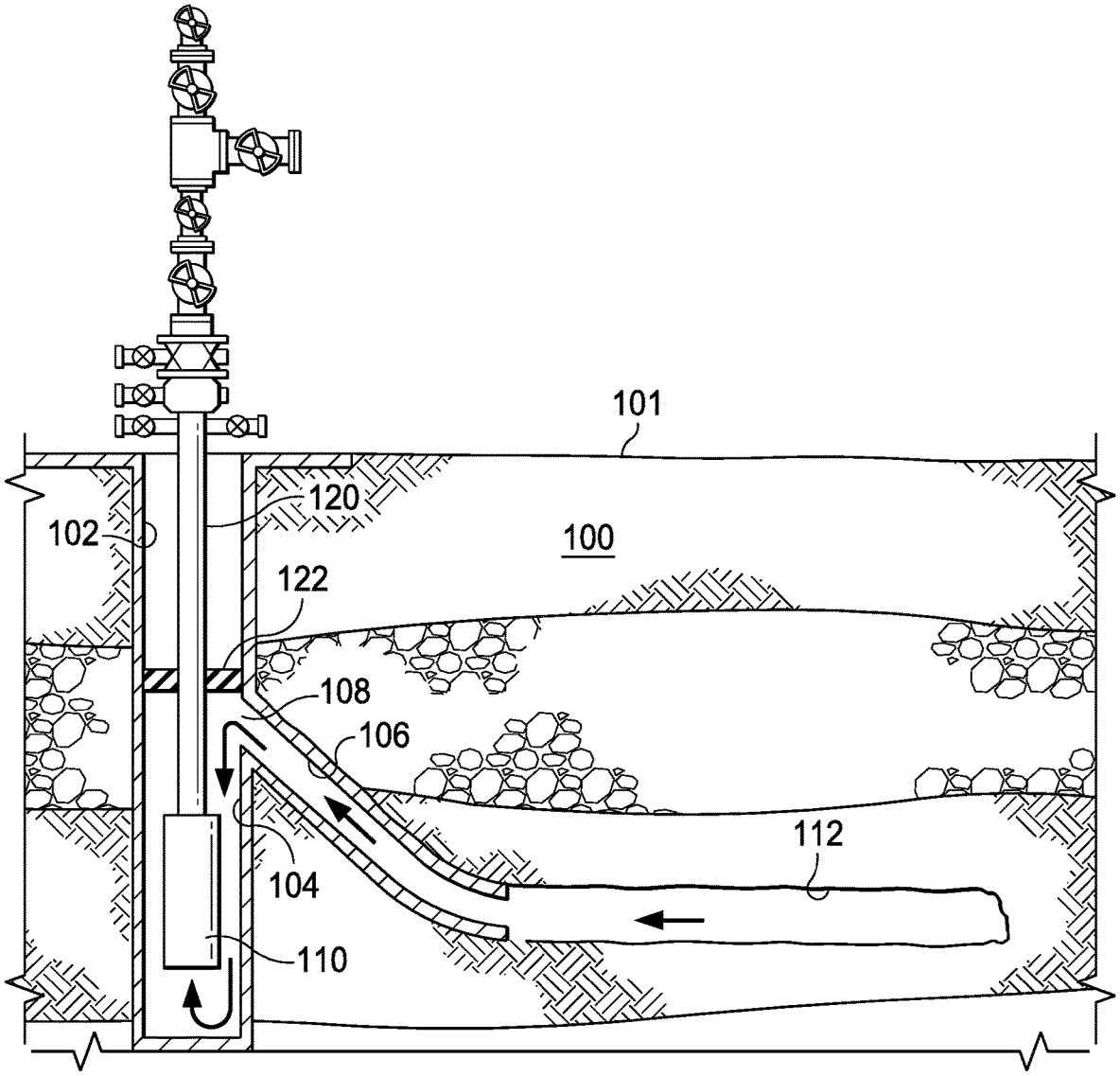
FIG. 1A is a schematic of an example of an ESP completion.

FIG. 1A is a schematic of an example of an ESP completion. As shown in FIG. 1A, a wellbore 102 is drilled from a surface 101 of the Earth into a subterranean zone 100 that has a subsurface hydrocarbon reservoir with trapped hydrocarbons. The subterranean zone 100 can include a formation, multiple formations, or a portion of a formation. The wellbore 102 includes a vertical wellbore portion 104 and a lateral wellbore portion 106 that is connected to the vertical wellbore portion 104 at a junction 108. In some implementations, the vertical wellbore portion 104 is formed by drilling a pilot or rat hole from a downhole end of the wellbore 102. For example, the vertical wellbore portion 104 extends into and terminates in the subsurface hydrocarbon reservoir. The portion needs to be long enough to accommodate the length of the ESP which is typically around 100'-120'. The lateral wellbore portion 106 is formed, for example, drilled using a whipstock, from a side wall of the vertical wellbore portion 104. The location on the vertical wellbore portion 104 from which the lateral wellbore portion 106 extends forms the junction 108. The lateral wellbore portion 106 can connect the wellbore 102 to an open horizontal well 112 formed within the subsurface hydrocarbon reservoir. Hydrocarbons in the reservoir can flow through the horizontal well 112 into the lateral wellbore portion 106 and then into the wellbore 102. The horizontal well 112 extends through the subsurface hydrocarbon reservoir. A depth of a downhole end of the vertical wellbore portion 104 from the surface 101 of the Earth is greater than a depth of the horizontal well 112 from the surface 101 of the Earth.

An ESP 110 can be installed in the vertical wellbore portion 104 to draw the hydrocarbons from the horizontal well 112. The ESP 110 is installed in the vertical wellbore portion 104 downhole of the junction 108. A depth of the ESP 110 from the surface 101 of the Earth is greater than the depth of the horizontal well 112.

Figure 1B:
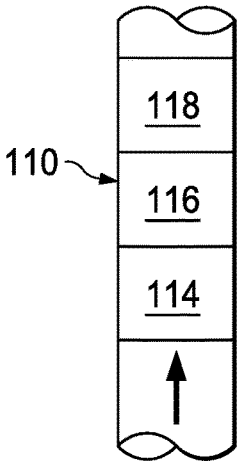
FIG. 1B is a schematic of an example of an ESP included in the ESP completion of FIG. 1A.

FIG. 1B is a schematic of an example of the ESP 110 included in the ESP completion of FIG. 1A. The ESP 110 includes a pump inlet 114 through which fluid is received, a motor 116 uphole of the pump inlet 114 to drive the pump 118, and pump 118 uphole of the motor 116. With the ESP 110 installed in the vertical wellbore portion 104 as described here, at least a portion of the hydrocarbons in the subsurface hydrocarbon reservoir are produced through the lateral wellbore portion 106 by operating the ESP 110. In particular, the ESP 110 draws the hydrocarbons from the subsurface hydrocarbon reservoir through the horizontal well 112 into the lateral wellbore portion 106. The ESP 110 continues to draw the hydrocarbons from the lateral wellbore portion 106 through the junction 108 in a downhole direction into the vertical portion 104. The produced hydrocarbons flow to and accumulate in a downhole end of the vertical wellbore portion 104. From the downhole end of the vertical wellbore portion 104, the ESP 110 draws the hydrocarbons into the pump inlet 114 and drives the hydrocarbons in an uphole direction towards the surface 101. In this manner, the hydrocarbons are produced through the horizontal well 112. In some implementations, the pump inlet 114, the motor 116, and the pump 118 can be installed within a shroud (not shown). The shroud causes the hydrocarbons drawn through the pump inlet 114 to flow past the motor 116, thereby cooling the motor 116.

By implementing the ESP 110 as described in this disclosure, a distance between the pump inlet 114 and the downhole end of the vertical wellbore portion 104 is reduced to minimize the height of the fluid column to be drawn by the ESP 110. For example, the distance can range between 60' and 150'. for the, you can go up to In general, the entirety of the ESP 110 is installed downhole of the junction 108 at a distance from the downhole end of the vertical wellbore portion 104 that reduces (or minimizes) the height of the fluid column to be drawn by the ESP 110.

Operation of the ESP 110 downhole of the junction 108 and in the vertical wellbore portion 104 generates a low-pressure region downhole of the ESP 110 in the vertical wellbore portion 104. The low-pressure region has a lower pressure compared to the lateral wellbore portion 106. The hydrocarbons in the horizontal well 112 are drawn into the low-pressure region within the vertical wellbore portion 104. From this location, the ESP 110 drives the hydrocarbons towards the surface 101. To do so, in some implementations, a production tubing 120 is installed uphole of the ESP 110 in the wellbore 102. The production tubing 120 is fluidically coupled to the ESP 110, for example, at an uphole end of the ESP 110, and extends to the surface 101. The ESP 110 drives the hydrocarbons accumulated at the downhole end of the vertical wellbore portion 104 towards the surface 101 through the production tubing 120.

In some implementations, an annulus defined between an outer surface of the production tubing 120 and an inner wall of the wellbore 102 uphole of the junction 108 is sealed. For example, a packer 122 is installed in the annulus uphole of the junction 108, thereby sealing the annulus. Sealing the annulus uphole of the junction 108 ensures that the hydrocarbons flow from the horizontal well 112 downhole toward the pump inlet 114 of the ESP 110. Sealing the annulus also maintains the low-pressure region generated by the ESP 110 near the downhole end of the vertical wellbore portion 104.

In some implementations, the vertical wellbore portion 104 and at least a portion of the lateral wellbore portion 106 can be cased. For example, the entirety of the vertical wellbore portion 104, including the downhole end of the vertical wellbore portion 104, can be cased. No hydrocarbons flow from the subsurface reservoir directly into the vertical wellbore portion 104. That is, there are no perforations in the casing of the vertical wellbore portion 104 to allow hydrocarbons from the subsurface hydrocarbon reservoir to flow directly into the vertical wellbore portion 104.

Figure 2:
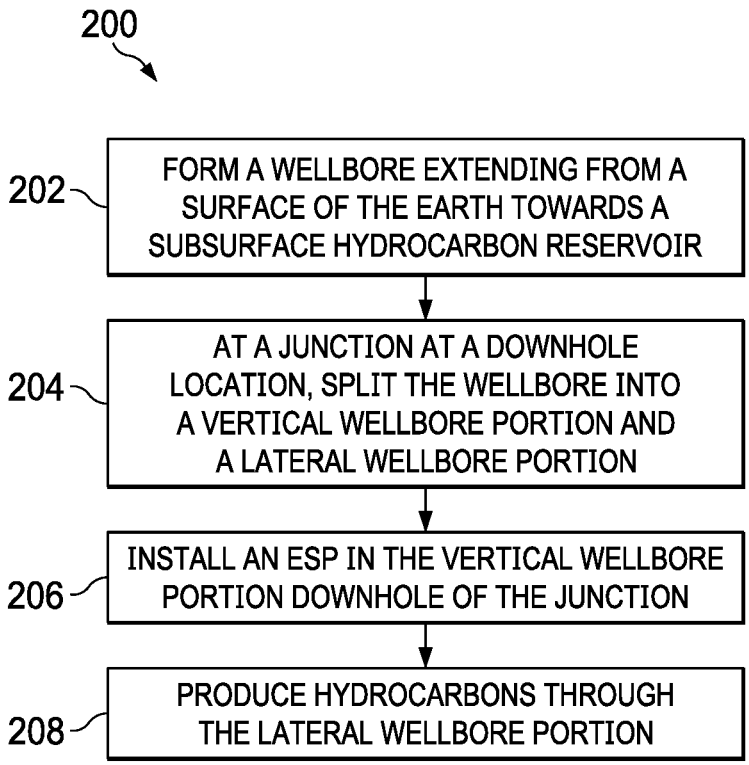
FIG. 2 is a flow chart of an example of a process.

FIG. 2B is a flow chart of an example of a process 200. Some portions of the process 200 are directed to completing the wellbore 102 using the ESP completion described in this disclosure. Some portions of the process 200 are directed to producing hydrocarbons through the wellbore 102 using the ESP completion described here. At 202, a wellbore is formed extending from the surface of the Earth towards a subsurface hydrocarbon reservoir carrying hydrocarbons. At 204, the wellbore is split into a vertical wellbore portion and a lateral wellbore portion deviating from the vertical wellbore portion. The vertical wellbore portion and the lateral wellbore portion meet at a junction in the wellbore. At 206, an ESP is installed in the vertical wellbore portion downhole of the junction. At 208, using the ESP, at least a portion of the hydrocarbons in the hydrocarbon reservoir are produced through the lateral wellbore portion. As described earlier, the lateral wellbore portion connects to a horizontal well extending into the subsurface hydrocarbon reservoir. The hydrocarbons from the subsurface hydrocarbon reservoir are produced through the horizontal well, through the lateral wellbore portion into the vertical wellbore portion, and from the vertical wellbore portion in an uphole direction toward the surface.

Thus, particular implementations of the subject matter have been described. Other implementations are within the scope of the following claims.

The invention claimed is:

1. A method comprising:

installing an electrical submersible pump (ESP) in a wellbore comprising a vertical wellbore portion and a lateral wellbore portion that is connected to the vertical wellbore portion at a junction, the ESP installed in the vertical wellbore portion downhole of the junction, the lateral wellbore portion extending to a subsurface hydrocarbon reservoir carrying hydrocarbons;

installing a packer in an annulus uphole of the junction, thereby sealing the annulus uphole of the junction to promote that fluids flowing from the lateral wellbore portion flow downhole toward a pump inlet of the ESP, wherein the annulus is defined between an outer surface of production tubing and an inner wall of the wellbore uphole of the junction; and producing, using the ESP, at least a portion of the hydrocarbons carried by the subsurface hydrocarbon reservoir through the lateral wellbore portion, wherein producing comprises drawing, by the ESP, at least the portion of the hydrocarbons from the subsurface hydrocarbon reservoir through the lateral wellbore portion and into the vertical wellbore portion, wherein no hydrocarbons flow from the subsurface hydrocarbon reservoir directly into the vertical wellbore portion, and wherein the vertical wellbore portion downhole of the junction comprises a lower pressure compared to the lateral wellbore portion.

2. The method of claim 1, wherein producing, using the ESP, at least the portion of the hydrocarbons through the lateral wellbore portion comprises driving, by the ESP, at least the portion of the hydrocarbons drawn into the vertical wellbore portion in an uphole direction through the production tubing towards a surface.

3. The method of claim 2, comprising:

casing the vertical wellbore portion to give the no hydrocarbons flow from the subsurface hydrocarbon reservoir directly into the vertical wellbore portion; and casing a portion of the lateral wellbore portion.

4. The method of claim 3, wherein casing the vertical wellbore portion comprises casing an entirety of the vertical wellbore portion including a downhole end of the vertical wellbore portion.

5. The method of claim 2, wherein drawing, by the ESP, at least the portion of the hydrocarbons from the subsurface hydrocarbon reservoir through the lateral wellbore portion and into the vertical wellbore portion comprises generating, by the ESP, a low pressure region within the vertical wellbore portion, the low pressure region having the lower pressure compared to the lateral wellbore portion, wherein at least the portion of the hydrocarbons is drawn into the low pressure region within the vertical wellbore portion, and wherein there are no perforations in casing of the vertical wellbore portion.

6. The method of claim 1, wherein the ESP comprises a motor and the pump inlet, the pump inlet configured to receive at least the portion of the hydrocarbons to be flowed by the ESP, the motor configured to drive the ESP, wherein installing the ESP in the wellbore downhole of the junction comprises installing the motor uphole of the pump inlet.

7. The method of claim 1, comprising:

installing the production tubing uphole of the ESP, the production tubing fluidically coupled to the ESP and extending to the surface, wherein producing, using the ESP, at least the portion of the hydrocarbons through the lateral wellbore portion comprises flowing at least the portion of the hydrocarbons through the production tubing; and promoting, via the sealing of the annulus with the packer, fluid flow from the lateral wellbore portion in a downhole direction toward the pump inlet, wherein the inner wall of the wellbore uphole of the junction is casing; and maintaining, via the sealing of the annulus with the packer, a low pressure region within the vertical wellbore portion, the low pressure region having the lower pressure compared to the lateral wellbore portion.

8. The method of claim 7, comprising installing casing along an entirety of the vertical wellbore portion including across an end at which the vertical wellbore portion terminates, wherein the inner wall of the wellbore uphole of the junction comprises the casing.

9. A method comprising:

forming a wellbore extending from a surface of the Earth towards a subsurface hydrocarbon reservoir carrying hydrocarbons;

at a junction at a downhole location, splitting the wellbore into a vertical wellbore portion and a lateral wellbore portion deviating from the vertical wellbore portion;

installing an electrical submersible pump (ESP) in the vertical wellbore portion downhole of the junction;

installing a packer in an annulus uphole of the junction, thereby sealing the annulus uphole of the junction to promote that fluids flowing from the lateral wellbore portion flow downhole toward a pump inlet of the ESP, wherein the annulus is defined between an outer surface of production tubing and an inner wall of the wellbore uphole of the junction; and producing, using the ESP, at least a portion of the hydrocarbons through the lateral wellbore portion, wherein producing comprises drawing, by the ESP, at least the portion of the hydrocarbons from the subsurface hydrocarbon reservoir through the lateral wellbore portion and into the vertical wellbore portion, wherein no hydrocarbons flow from the subsurface hydrocarbon reservoir directly into the vertical wellbore portion, and wherein the vertical wellbore portion downhole of the junction comprises a lower pressure compared to the lateral wellbore portion.

10. The method of claim 9, wherein producing, using the ESP, at least the portion of the hydrocarbons through the lateral wellbore portion comprises producing at least the portion of the hydrocarbons from the subsurface hydrocarbon reservoir through the lateral wellbore portion into the vertical wellbore portion and, from the vertical wellbore portion, in an uphole direction towards the surface.

11. The method of claim 10, further comprising:

casing the vertical wellbore portion, wherein there are no perforations in casing of the vertical wellbore portion, and wherein the inner wall of the wellbore uphole of the junction comprises the casing; and casing a portion of the lateral wellbore portion.

12. The method of claim 11, wherein casing the vertical wellbore portion comprises casing an entirety of the vertical wellbore portion including a downhole end of the vertical wellbore portion, and wherein sealing the annulus maintains a low pressure region in the vertical wellbore portion, the low pressure region comprising the lower pressure compared to the lateral wellbore portion.

13. The method of claim 9, wherein the ESP comprises a motor and a pump inlet, the pump inlet configured to receive at least the portion of the hydrocarbons to be flowed by the ESP, the motor configured to drive the ESP, wherein installing the ESP in the wellbore downhole of the junction comprises installing the motor uphole of the pump inlet.

14. The method of claim 9, comprising installing the production tubing uphole of the ESP, the production tubing fluidically coupled to the ESP and extending to the surface, wherein producing, using the ESP, at least the portion of the hydrocarbons through the lateral wellbore portion comprises flowing at least the portion of the hydrocarbons through the production tubing.

15. The method of claim 14, comprising installing casing along an entirety of the vertical wellbore portion including across a terminating end of the vertical wellbore portion.

16. A method comprising:

forming a wellbore extending from a surface of the Earth towards a subsurface hydrocarbon reservoir carrying hydrocarbons;

at a junction at a downhole location, splitting the wellbore into a vertical wellbore portion and a lateral wellbore portion deviating from the vertical wellbore portion;

installing an electrical submersible pump (ESP) in the vertical wellbore portion downhole of the junction;

installing a packer in an annulus uphole of the junction, thereby sealing the annulus uphole of the junction to promote that fluids flowing from the lateral wellbore portion flow downhole toward a pump inlet of the ESP, wherein the annulus is defined between an outer surface of production tubing and an inner wall of the wellbore uphole of the junction; and producing, using the ESP, at least a portion of the hydrocarbons through the lateral wellbore portion, wherein producing comprises drawing, by the ESP, at least the portion of the hydrocarbons from the subsurface hydrocarbon reservoir through the lateral wellbore portion and into the vertical wellbore portion, wherein the vertical wellbore portion downhole of the junction comprises a low pressure region having a lower pressure compared to the lateral wellbore portion, wherein there are no perforations in casing of the vertical wellbore portion, and wherein no hydrocarbons flow from the subsurface hydrocarbon reservoir directly into the vertical wellbore portion.

17. The method of claim 16, comprising installing the production tubing fluidically coupled to the ESP, the production tubing installed uphole of the ESP and extending to the surface, wherein at least the portion of the hydrocarbons is produced through the production tubing, wherein the ESP comprises the pump inlet that receives at least the portion of the hydrocarbons pumped by the ESP and a motor that the drives the ESP, and wherein the motor is uphole of the pump inlet.

18. The method of claim 17, comprising installing casing along an entirety of the vertical wellbore portion including across a terminating end of the vertical wellbore portion.

19. The method of claim 18, wherein sealing the annulus uphole of the junction maintains the low pressure region.

* * * * *